United States Patent [19]

Talbot

[11] 4,247,509

[45] Jan. 27, 1981

[54] BOAT WEATHERIZATION WITH HEAT-SHRUNK PLASTIC FILM

[75] Inventor: James E. Talbot, Wynnewood, Pa.

[73] Assignee: Talpak, Inc., Wynnewood, Pa.

[21] Appl. No.: 17,351

[22] Filed: Mar. 5, 1979

[51] Int. Cl.[3] ..... B29C 17/00; B63B 35/72; B63C 15/00

[52] U.S. Cl. ..... 264/230; 9/1.5; 264/DIG. 71

[58] Field of Search ..... 264/230, 342 R, DIG. 71; 9/1.5, 6 P

[56] References Cited

U.S. PATENT DOCUMENTS

| | | | |
|---|---|---|---|
| 2,536,152 | 1/1951 | Bass | 9/1.5 |
| 3,014,256 | 12/1961 | Derrickson et al. | 24/26 |
| 3,075,248 | 1/1963 | Harrison | 264/342 R |
| 3,475,772 | 11/1969 | Lokken | 9/1.5 |
| 3,779,694 | 12/1973 | Zagoroff | 431/347 |
| 4,075,723 | 2/1978 | Bareis | 9/1.5 |

FOREIGN PATENT DOCUMENTS

| | | | |
|---|---|---|---|
| 539796 | 9/1941 | United Kingdom | 9/1.5 |

*Primary Examiner*—James B. Lowe
*Attorney, Agent, or Firm*—James A. Drobile

[57] ABSTRACT

Boats are weatherized for temporary storage, as over winter, by enclosing the deck and superstructure with a heat shrunk unitary plastic film. Tie lines terminating in loops are hung from the rub rail or other deck level attachment and extend a portion of the distance between the deck and water line. Bridge straps are run from bow to stern and the boat is draped with a single plastic film of sufficient size to extend below the tie line loops, a tie-down strap is passed through the loops to tightly secure the film about the boat hull and the entire plastic film is subjected to heat sufficient to shrink the film and produce a tight and taut membraneous cover.

10 Claims, 4 Drawing Figures

BOAT WEATHERIZATION WITH HEAT-SHRUNK PLASTIC FILM

BACKGROUND OF THE INVENTION

This invention relates generally to the weatherization of boats for over winter storage and the like.

More particularly, this invention relates to a method for applying a unitary plastic film covering over the deck and superstructure of a boat.

Description of the Prior Art:

Boats, particularly those with open cockpit areas, require protective storage during any extended period of non-use, such as over winter. Shed storage, either in or out of the water has usually been the preferred method. In those circumstances where shed storage is not available, the cockpit area and sometimes all open deck areas are covered with tarpaulins and secured.

Tarpaulins are typically made of heavy canvas and tend to collect quantities of water and ice in unsupported pockets. They are heavy and awkward to install and, unless custom fabricated for each particular boat, do not easily provide a weather tight fit. As they are opaque, it is impossible to check a boat for pilferage or damage without removing the tarpaulin cover.

The concept of shrink wrapping industrial goods is well known and has gained a widespread acceptance. This technique is often used to secure and protect palletized goods for storage and shipment and to provide a temporary protective wrapping for industrial equipment and machinery. In practice, a heat-shrinkable plastic film is draped over the object to be covered and is secured at the base thereof. The film is thereafter subjected to heat by passing the plastic-covered object through an oven, as is often practiced with palletized loads, or by applying heat to the film with a heat gun which may be either the electric or combustion type.

While shrink wrapping has been considered applicable in concept for covering boats, the unusual geometry and large unsupported areas of a boat covering has precluded its successful use for this purpose.

SUMMARY OF THE INVENTION:

Boats are covered with a unitary plastic film which is heat shrunk to provide a weather tight covering having sufficient strength to withstand severe weather conditions including wind, rain, snow and hail. The plastic film is secured about the periphery of the boat at a level below the deck but above the water line by a plurality of non-metallic loops through which a tie down strap is passed and secured. Bridging straps are provided which pass generally from bow to stern to provide support over open cockpit and deck areas. Thereafter, the plastic film is shrunk by local application of heat beginning with the perimeter along the tie down strap and proceeding over the entire film surface.

Thus, it is an object of this invention to weatherize boats for temporary unprotected storage.

It is another object of this invention to provide a method for applying a unitary, heat shrunk plastic film to seal the top side of a boat.

Another object of this invention is to provide a method for the over-winter storage of boats.

GENERAL DISCUSSION OF THE INVENTION

Previous attempts to adapt industrial shrink wrapping techniques for the covering of boats have been generally unsuccessful because of the complex geometry of the boat hull and because of the large unsupported areas over the boat deck. The film could not be secured to the boat hull which precluded the successful shrinking of the plastic film to provide a taut and strong covering.

The method of this invention provides a tight and secure seal between the plastic film and boat hull which anchors the unitary film to completely cover the entire deck and cockpit areas. It is easy and inexpensive to install and provides sufficient strength to withstand wind, snow, rain and hail without damage or puncture. The plastic film can be either opaque, to protect against sun damage, or transparent or semi-transparent to allow visual inspection for pilferage or damage. At the end of the storage period, typically after winter, the film may be removed and the boat readied for operation in a very short time, usually a matter of minutes.

Figure 1:
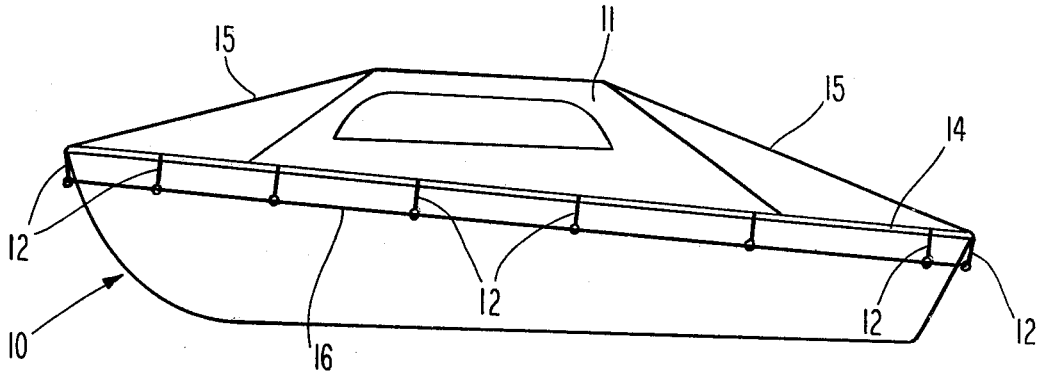
FIG. 1 is a side view of a boat illustrating generally the method of securing and supporting the plastic film.

The procedure for preparing a boat for shrink covering may best be described by reference to the drawings. Referring first to FIG. 1, there is shown a boat 10 having a cabin or bridge structure 11. The boat is prepared by first taping all sharp points and corners which may contact the film. Tie lines 12 terminating in loops 13 are then attached to the rub rail 14 or other convenient point so that the loops extend to a common level on the hull, preferably intermediate the deck and water line. The tie lines and loops must be non-metallic and may conveniently be a heavy nylon, rayon, polyester or polypropylene strapping or cord. While spacing of the tie lines and loops is not critical, it is preferred that the distance between adjacent loops not exceed about 4 to 6 feet.

Special safety precautions must be observed on all boats having inboard gasoline tanks. The tank vent must be sealed before the plastic covering is put in place. Failure to do so can result in gasoline fumes accumulating beneath the plastic film. Application of heat during the film shrinking step can ignite the accumulated fumes resulting in an explosion and possible fire. In most cases, the gasoline tank vent may be securely sealed by taping it closed during the heat-shrinking step.

Figure 2:
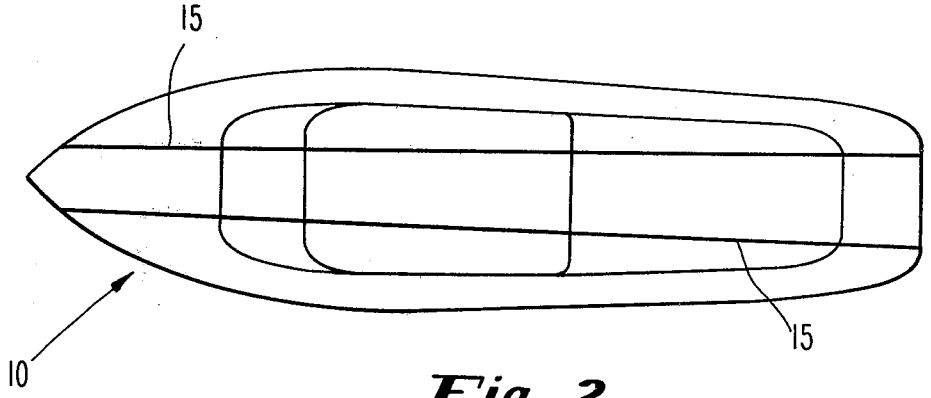
FIG. 2 is a top view showing placement of bridging straps.

Bridging lines or straps 15, best shown in FIG. 2, are then run generally from bow to stern over the cabin or bridge structure and tensioned by any convenient means such as a turn buckle. Bridging lines 15 must be non-metallic and may conveniently comprise heat resistant polyester or light nylon rope or strapping. One bridging line is usually sufficient for small boats, as for example an outboard motor boat of 15 to 18 feet in length, but a plurality of bridging straps are required for a larger boat, such as a cabin cruiser of 35 to 50 feet in length.

Next, plastic film is draped over the boat. The film may comprise any of those conventionally used in shrink packaging, such as polyvinyl chloride, polyethylene, polypropylene and the like, having approximately equal shrink coefficients in transverse and longitudinal directions, i.e., biaxially-oriented. A preferred film is natural, low density, biaxially-oriented, virgin polyethylene film of 3 to 10 mils, most preferably about 6 mils, in thickness. This film is commercially available in rolls in widths up to 20 feet which suffices for most small boats. Greater film widths for larger boats may be fabricated on site by heat sealing two or more film strips together.

The film is drawn snugly over the boat and is trimmed to extend a short distance, 6 inches or so, below the level of loops 13. Cuts are made in the film at each loop to allow passage of the loop to the outside of the film. A tie-down strap 16 is then passed through the loops around the perimeter of the boat and is secured and tensioned by any convenient means. One convenient device for tensioning either the tie-down strap or the bridge straps, or both, is the buckle described in U.S. Pat. No. 3,014,256, which is marketed by FMC Corporation, of Philadelphia, Pennsylvania. As may be appreciated, the loops function to prevent the tie-down strap from sliding down the boat hull as it is tightened. Tie-down strap 16 may comprise heat resistant polyester or nylon strapping or light rope.

Figure 3:
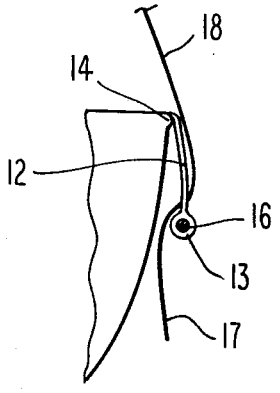
FIG. 3 is a partial assembly view of the tie lines and loops in relationship to the plastic film.
Figure 4:
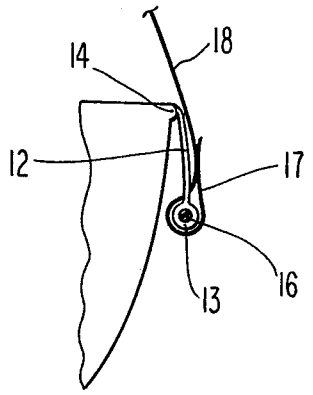
FIG. 4 illustrates the assembled relationship of tie lines and loops with the film and tie down strap.

After the tie-down strap is secured, the loose plastic skirt 17 hanging below the strap is folded upwardly and fastened to the plastic covering 18 as is illustrated in FIGS. 3 and 4. Any adhesive compatible with the plastic film may be used for this purpose as may appropriate adhesive tapes. At this point, the plastic film is securely anchored around the perimeter of the boat and will not pull loose under the stresses produced by heat shrinking.

The plastic film covering is now ready for heat shrinking. Shrinking is accomplished by the application of heat over the entire surface of the film beginning at the perimeter along the tie-down strap and working systematically around the boat finishing at the top center. Application of heat is accomplished using commercial heat guns of either the electric or combustion types. A preferred heat gun is that described in U.S. Pat. No. 3,779,694 which is marketed by the Gloucester Engineering Co., Inc. of Newport, N.H. This heat gun produces heated air at a temperature in the range of 250° to 1000° F., is fueled by propane, is light and hand-held and is well suited for this application.

The heat shrinking step produces a taut, strong, essentially vapor-tight enclosure over the entire deck surface and superstructure of the boat. In order to avoid moisture condensation on the interior boat and plastic surfaces, it is desirable to install one or more vents, which may be of the screen or flap type, in the film cover at a point above the rub rail. Alternatively, dessicant canisters can be placed within the boat prior to covering it with the plastic film to absorb and retain excess moisture.

The method of this invention provides a simple, economical and practical means for weatherizing and protecting a boat for storage. A 24-foot boat may be encapsulated in as little as about 40 minutes. While this invention is expected to find most use in the weatherization of boats for outside, over-winter storage, it is also useful for longer term boat storage under more protected conditions. At the conclusion of the storage period, a boat may be prepared for use in a matter of minutes by stripping the film and removing the film securing and supporting straps.

I claim:

1. A method for weatherizing a boat which comprises:

attaching a plurality of tie lines to the boat at or near the deck surface, said tie lines terminating in loops at a level intermediate the deck and water line;

installing at least one bridging strap, said strap extending generally from bow to stern and passing over the boat superstructure;

draping a unitary, heat shrinkable, plastic film over the entire boat, said film extending to a level below the loops of said tie lines;

piercing the film at each loop and passing each loop through the opening thereby formed;

passing a tie-down strap through said loops around the perimeter of the boat and external to said film whereby the film is securely pressed against the boat hull;

folding the plastic film skirt extending below the tie-down strap upwardly about the tie-down strap and fastening it to the plastic film above the tie-down strap, and shrinking the plastic film by application of heat beginning at the perimeter along the tie-down strap and finishing at the top center of the boat.

2. The method of claim 1 wherein said boat is equipped with inboard gasoline tanks and wherein the vents of said tanks are sealed prior to covering the boat with said plastic film.

3. The method of claim 1 wherein said heat shinkable plastic film is low density polyethylene having a thickness ranging from about 3 to 10 mils.

4. The method of claim 3 wherein said film thickness is about 6 mils.

5. The method of claim 1 wherein at least one vent is provided in said film, the vent allowing air communication between the atmosphere and the boat interior.

6. The method of claim 1 wherein a dessicant is placed within the boat prior to covering with said plastic film to absorb and retain excess moisture.

7. The method of claim 1 wherein said bridging straps, tie lines, loops and tie-down straps are of heat-resistant, plastic material.

8. The method of claim 7 wherein said plastic material is selected from the group consisting of polyester, nylon and polypropylene in cordage or strap form.

9. The method of claim 1 wherein heat is applied to shrink said plastic film using a heat gun.

10. The method of claim 9 wherein said heat gun is hand-held and propane fired.

* * * * *